US011440769B2

(12) United States Patent
Fauconnet

(10) Patent No.: US 11,440,769 B2
(45) Date of Patent: Sep. 13, 2022

(54) AUTOMATIC ELEVATOR INSPECTION SYSTEMS AND METHODS

(71) Applicant: Otis Elevator Company, Farmington, CT (US)

(72) Inventor: Aurelien Fauconnet, Isdes (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 1164 days.

(21) Appl. No.: 15/973,622

(22) Filed: May 8, 2018

(65) Prior Publication Data

US 2018/0327220 A1 Nov. 15, 2018

(30) Foreign Application Priority Data

May 12, 2017 (EP) ..... 17305542

(51) Int. Cl.

| | |
|---|---|
| ***B66B 5/00*** | (2006.01) |
| ***B66B 13/22*** | (2006.01) |
| ***B66B 9/00*** | (2006.01) |
| ***B66B 13/16*** | (2006.01) |

(52) U.S. Cl.

CPC ..... *B66B 5/0025* (2013.01); *B66B 5/0087* (2013.01); *B66B 9/00* (2013.01); *B66B 13/16* (2013.01); *B66B 13/22* (2013.01)

(58) Field of Classification Search

CPC ..... B66B 5/0031; B66B 5/0087; B66B 13/22; B66B 5/0025; B66B 5/02; B66B 5/005; B66B 5/0018; B66B 5/00; B66B 5/0006; B66B 13/14; B66B 13/16; B66B 11/0246; B66B 3/002; B66B 13/24; B66B 13/20; B66B 13/00; B66B 5/0012; B66B 13/02; B66B 25/006

See application file for complete search history.

(56) References Cited

U.S. PATENT DOCUMENTS

| | | | | |
|---|---|---|---|---|
| 5,135,081 | A | 8/1992 | Watt et al. | |
| 6,435,315 | B1 | 8/2002 | Zaharia | |
| 6,612,403 | B2 | 9/2003 | Silberhorn et al. | |
| 7,650,970 | B2 | 1/2010 | Lelic et al. | |
| 8,857,572 | B2 * | 10/2014 | Leutenegger | B66B 3/023 187/394 |

(Continued)

FOREIGN PATENT DOCUMENTS

| | | |
|---|---|---|
| CN | 1642841 A | 7/2005 |
| CN | 2885801 Y | 4/2007 |

(Continued)

OTHER PUBLICATIONS

European Search Report, European Application No. 17305542.7, dated Nov. 24, 2017, European Patent Office; European Search Report 7 pages.

*Primary Examiner* — Marlon T Fletcher
(74) *Attorney, Agent, or Firm* — Cantor Colburn LLP

(57) ABSTRACT

Elevator systems and methods including an elevator car within an elevator shaft, at least one component subject to inspection, the at least one component having an indicator element thereon, and an inspection system comprising a detector located on the elevator car and arranged to detect the presence of the indicator element in a detection region such that when the indicator element is detected within the detection region, a notification regarding a state of operation of the at least one component is generated.

20 Claims, 8 Drawing Sheets

(56) References Cited

U.S. PATENT DOCUMENTS

| | | | | |
|---|---|---|---|---|
| 8,960,376 | B2 | 2/2015 | Coi | |
| 9,352,934 | B1 | 5/2016 | Lee | |
| 9,399,562 | B2 | 7/2016 | Terry et al. | |
| 9,469,501 | B2 | 10/2016 | Lee | |
| 2005/0034931 | A1* | 2/2005 | Deplazes | B66B 13/125 187/313 |
| 2006/0232789 | A1 | 10/2006 | Oh et al. | |
| 2008/0156591 | A1* | 7/2008 | Tracey | B66B 1/3492 187/394 |
| 2008/0271955 | A1 | 11/2008 | Lelic et al. | |
| 2017/0015521 | A1* | 1/2017 | Toutaoui | B66B 13/02 |
| 2018/0208432 | A1* | 7/2018 | Yamada | B66B 13/22 |

FOREIGN PATENT DOCUMENTS

| | | | | | |
|---|---|---|---|---|---|
| CN | 201473135 | | | 5/2010 | |
| CN | 103058039 | | | 4/2013 | |
| CN | 202880596 | U | | 4/2013 | |
| CN | 103322930 | | | 9/2013 | |
| CN | 105173949 | | | 12/2015 | |
| CN | 111824912 | A | * | 10/2020 | |
| CN | 112125106 | A | * | 12/2020 | B66B 13/08 |
| CN | 111410105 | B | * | 9/2021 | B66B 13/165 |
| EP | 3401261 | A1 | * | 11/2018 | B66B 13/16 |
| EP | 3599204 | A1 | * | 1/2020 | B66B 13/06 |
| EP | 3599207 | A1 | * | 1/2020 | B66B 1/3461 |
| EP | 3730440 | A1 | * | 10/2020 | |
| JP | H07206341 | | | 8/1995 | |
| JP | H10114484 | A | | 5/1998 | |
| JP | 5278146 | | | 9/2013 | |
| JP | 2014076871 | | | 5/2014 | |
| JP | 6735048 | B1 | * | 8/2020 | B66B 13/18 |
| KR | 20040029179 | A | * | 4/2004 | B66B 13/12 |
| WO | WO-03080495 | A1 | * | 10/2003 | B66B 13/125 |
| WO | 2015118064 | | | 8/2015 | |

* cited by examiner

AUTOMATIC ELEVATOR INSPECTION SYSTEMS AND METHODS

CROSS-REFERENCE TO RELATED APPLICATIONS

This application claims the benefit of European Application No. 17305542.7, filed May 12, 2017, which is incorporated herein by reference in its entirety.

BACKGROUND

The subject matter disclosed herein generally relates to elevator systems and, more particularly, elevator inspection systems and methods.

Various components and features of elevator systems require inspection to comply with elevator code(s). Such components and features can include brakes, cables, locks, actuators, etc.

For example, elevator systems have landing door locks that are arranged to securely lock landing doors when an elevator car is not present at the specific landing. The landing door locks can also be unlocked by authorized persons to enable elevator maintenance. The landing door locks must be inspected from time to time in order to meet code requirements (e.g., landing door lock engagement length). Such inspections may be performed manually using a gauge. It may be advantageous to enable improved inspection techniques for landing door locks of elevator systems.

SUMMARY

According to some embodiments, elevator systems are provided. The elevator systems include an elevator car within an elevator shaft, at least one component subject to inspection, the at least one component having an indicator element thereon, and an inspection system comprising a detector located on the elevator car and arranged to detect the presence of the indicator element in a detection region such that when the indicator element is detected within the detection region, a notification regarding a state of operation of the at least one component is generated.

In addition to one or more of the features described herein, or as an alternative, further embodiments of the elevator systems may include that the at least one component subject to inspection is a landing door lock.

In addition to one or more of the features described herein, or as an alternative, further embodiments of the elevator systems may include a control unit, the control unit generating a notification when the indicator element is detected within the detection region.

In addition to one or more of the features described herein, or as an alternative, further embodiments of the elevator systems may include that the indicator element is at least one of a colored paint, a textured surface, or a reflective surface.

In addition to one or more of the features described herein, or as an alternative, further embodiments of the elevator systems may include a landing within the elevator shaft, the landing having a landing door and wherein the at least one component subject to inspection is a landing door lock, the landing door lock having a first body and a second body, wherein the first body and the second body are arranged to lock the landing door, wherein at least one of the first body or the second body includes the indicator element.

In addition to one or more of the features described herein, or as an alternative, further embodiments of the elevator systems may include that the first body is fixedly attached to the landing door and is movable with movement of the landing door and the second body is fixedly attached to a landing door frame.

In addition to one or more of the features described herein, or as an alternative, further embodiments of the elevator systems may include that the first body comprises a securing element and the second body comprises a locking element, wherein the locking element releasably engages with the locking element to lock the landing door.

In addition to one or more of the features described herein, or as an alternative, further embodiments of the elevator systems may include that the first body comprises a locking element and the second body comprises a securing element, wherein the locking element releasably engages with the locking element to lock the landing door.

In addition to one or more of the features described herein, or as an alternative, further embodiments of the elevator systems may include that the indicator element is present on a portion of the respective first body or second body such that when the indicator element is detected within the detection region an error of the landing door lock exists.

In addition to one or more of the features described herein, or as an alternative, further embodiments of the elevator systems may include that detection of the indicator element within the detection region indicates proper operation of the at least one component.

In addition to one or more of the features described herein, or as an alternative, further embodiments of the elevator systems may include that detection of the indicator element within the detection region indicates a malfunction with operation of the at least one component.

According to some embodiments, methods for inspecting components of elevator systems are provided. The methods include moving an elevator car to a landing within an elevator shaft, observing a detection region using a detector located on the elevator car, the detection region being a region of the component to be inspected, determining if an indicator element is present within the detection region, and generating a notification when the indicator element is present within the detection region.

In addition to one or more of the features described herein, or as an alternative, further embodiments of the methods may include a landing within the elevator shaft, the landing having a landing door and the component subject to inspection is a landing door lock, the landing door lock having a first body and a second body, wherein the first body and the second body are arranged to lock the landing door, wherein at least one of the first body or the second body includes the indicator element.

In addition to one or more of the features described herein, or as an alternative, further embodiments of the methods may include moving the elevator car to a second landing within the elevator shaft, observing a detection region of the second landing using the detector, the detection region being a region of a component to be inspected at the second landing, determining if an indicator element at the second landing is present within the detection region, and generating an error notification when the indicator element is present within the detection region.

In addition to one or more of the features described herein, or as an alternative, further embodiments of the methods may include that the method is performed automatically based on at least one of (i) a maintenance schedule, (ii) a predetermined interval, (iii) every time the elevator stops at a landing, (iv) a customer complaint, (v) a request made at an onsite location, (vi) a request made at an offsite location, or (vii) a scheduled maintenance visit.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
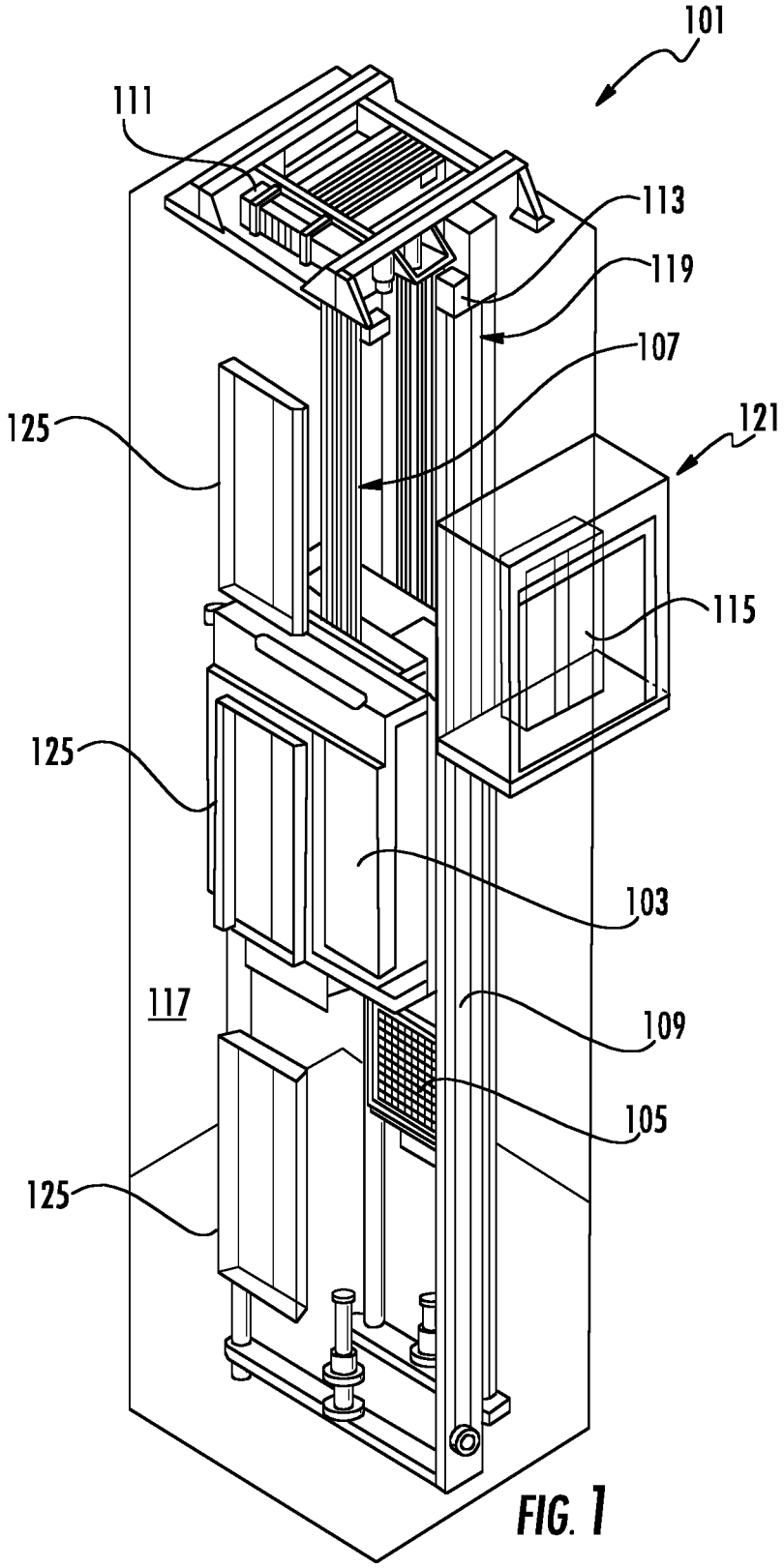
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Elevators are subject to inspection and monitoring to satisfy code requirements. However, inspection, monitoring, associated repairs, etc. can be time consuming. Accordingly, it may be advantageous to develop systems, devices, and processes to improve the efficiency of inspection and monitoring of various components, features, operations, etc. of elevator systems. For example, in accordance with embodiments of the present disclosure, systems and processes are provided to reduce the time needed to inspect and/or maintain elevators and/or to automatically perform inspections and/or monitoring operations.

One component of note for inspection and ensuring proper operation is a landing door lock. A landing door lock is a lock on a landing door that ensures that the landing doors do not open when an elevator car is not present. That is, landing door locks are provided to prevent unauthorized access to an elevator shaft and/or inadvertent access to the elevator shaft. For example, according to some specifications, a locking element must engage with a securing element of a landing door lock with a specific tolerance or amount of engagement. In a non-limiting example, the locking element must engage with an engaging length that is 7 mm or greater. This engaging length may be inspected (for each and every landing door lock within an elevator shaft) regularly, such as bi-weekly, or at any other desired interval. Such inspection, when performed by a technician or mechanic, can be time consuming and costly. Accordingly, having an automated inspection system for checking landing door lock engagement may be beneficial.

Figure 2A:
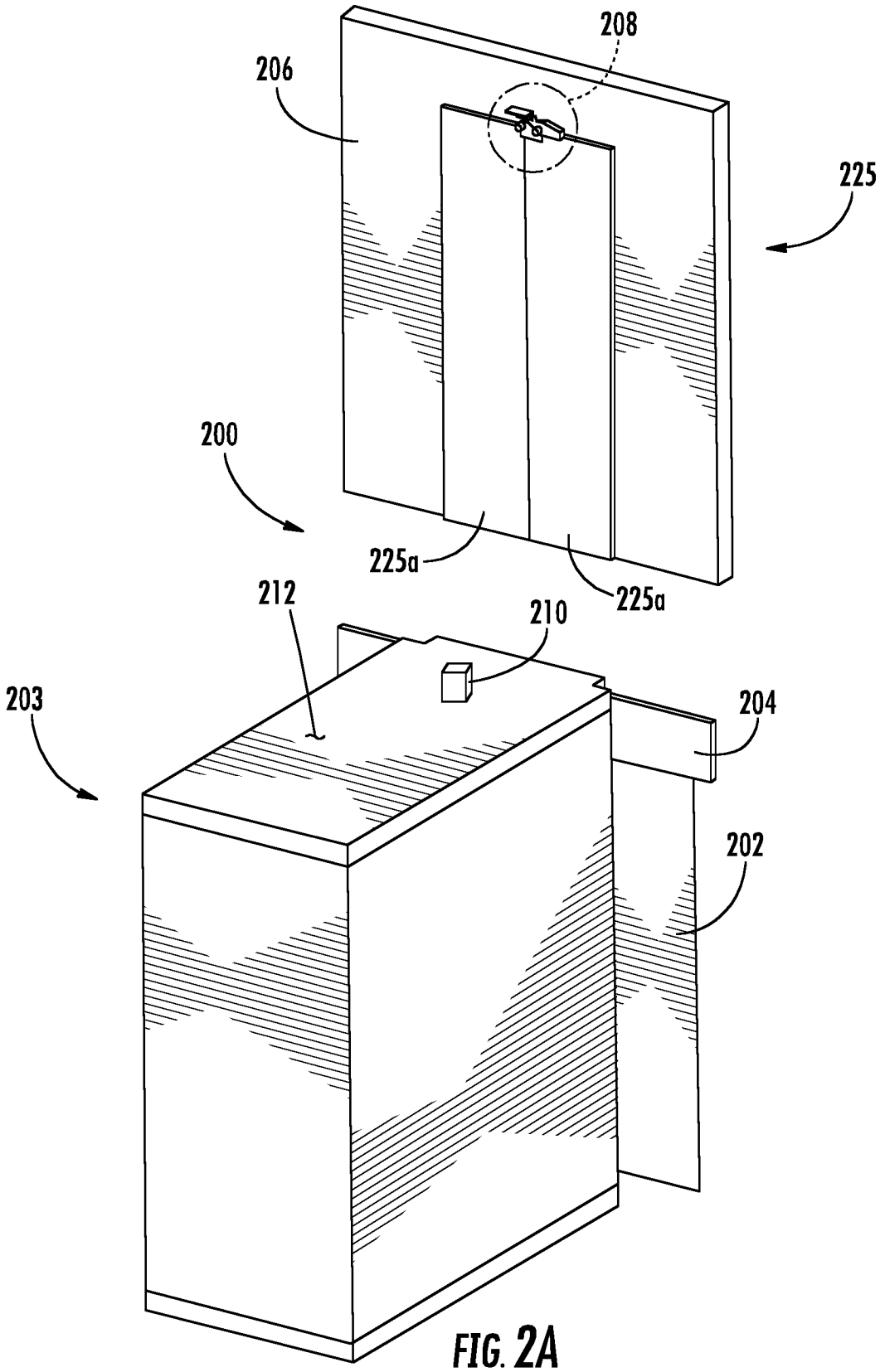
FIG. 2A is a schematic illustration of an elevator car having landing door lock inspection system in accordance with an embodiment of the present disclosure.

Although shown and described herein with respect to landing door lock inspection, those of skill in the art will appreciate that inspection systems as described herein can be employed for inspection of various different elevator components and features, including, but not limited to, brakes, safety devices, cables/ropes/etc., elevator car door mechanisms, etc. Thus, the present disclosure is not to be limiting but rather is provided as an example of inspection systems contemplated herein Turning now to FIGS. 2A-2C, schematic illustrations of a landing door lock inspection system 200 in accordance with an embodiment of the present disclosure are shown. FIG. 2A schematically illustrates an elevator car 203 and a landing 225 having landing doors 225*a*. The elevator car 203 has elevator car doors 202 and a car lintel 204. When the elevator car 203 is located at the landing door 225*a*, the car lintel 204 can align with a portion of a landing door frame 206 that includes a landing door lock 208. The landing door frame 206 can includes a landing door lintel, as will be appreciated by those of skill in the art. A mechanism within the car lintel 204 can engage with and unlock the landing door lock 208 to allow the landing doors 225*a* to open when the elevator car doors 202 open. Although shown with the landing door lock 208 positioned at the top of the landing doors 225*a*, those of skill in the art will appreciate that the location of the landing door lock is not to be limiting, and other arrangements are possible without departing from the scope of the present disclosure.

To monitor the operation of the landing door lock 208, the landing door lock inspection system 200 includes a detector 210 positioned on the elevator car 203. The detector 210 and/or other detectors can be positioned at one or more locations on the exterior of the elevator car 203 (e.g., top, bottom, sides) and/or mounted within the elevator car 203. If mounted on the exterior, the detector may have direct line of sight to one or more features within the elevator shaft. However, in embodiments with the detector installed on an interior portion of the elevator car, a window, opening, or other mechanism can be provided to enable the detector to be able to view features within the elevator shaft (e.g., external from the elevator car).

Figure 2B:
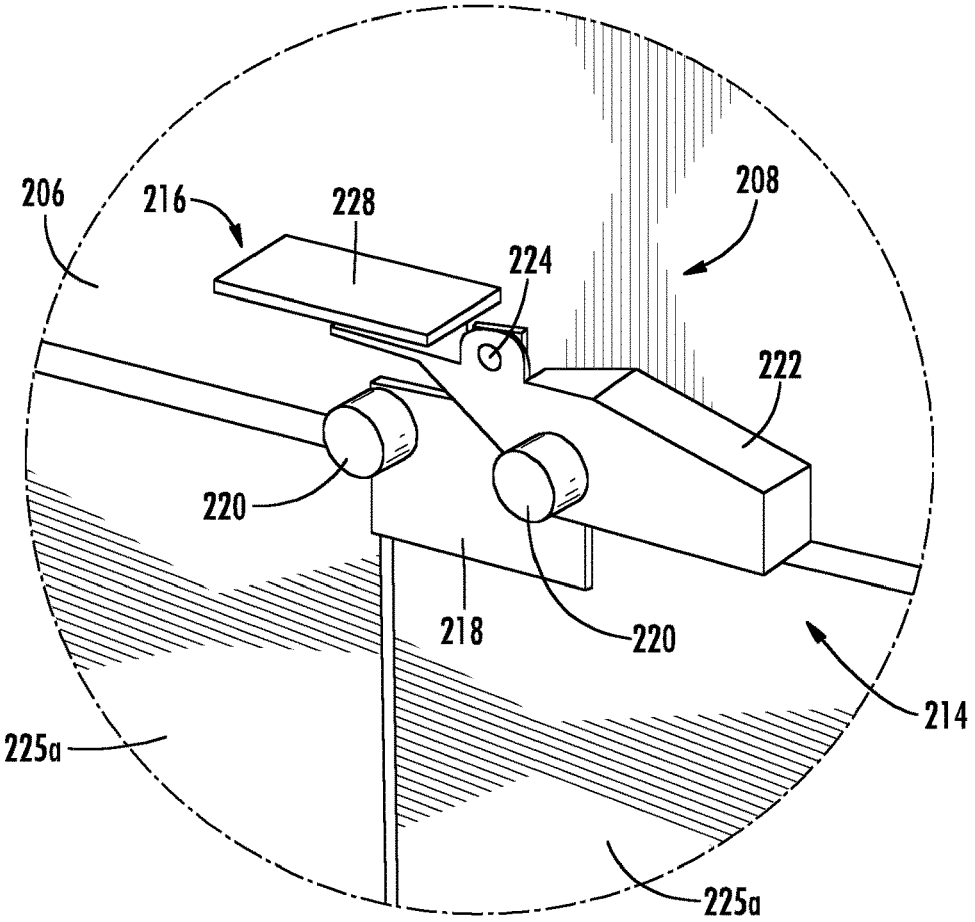
FIG. 2B is an enlarged illustration of a landing door lock of the elevator door lock inspection system of FIG. 2A.
Figure 2C:
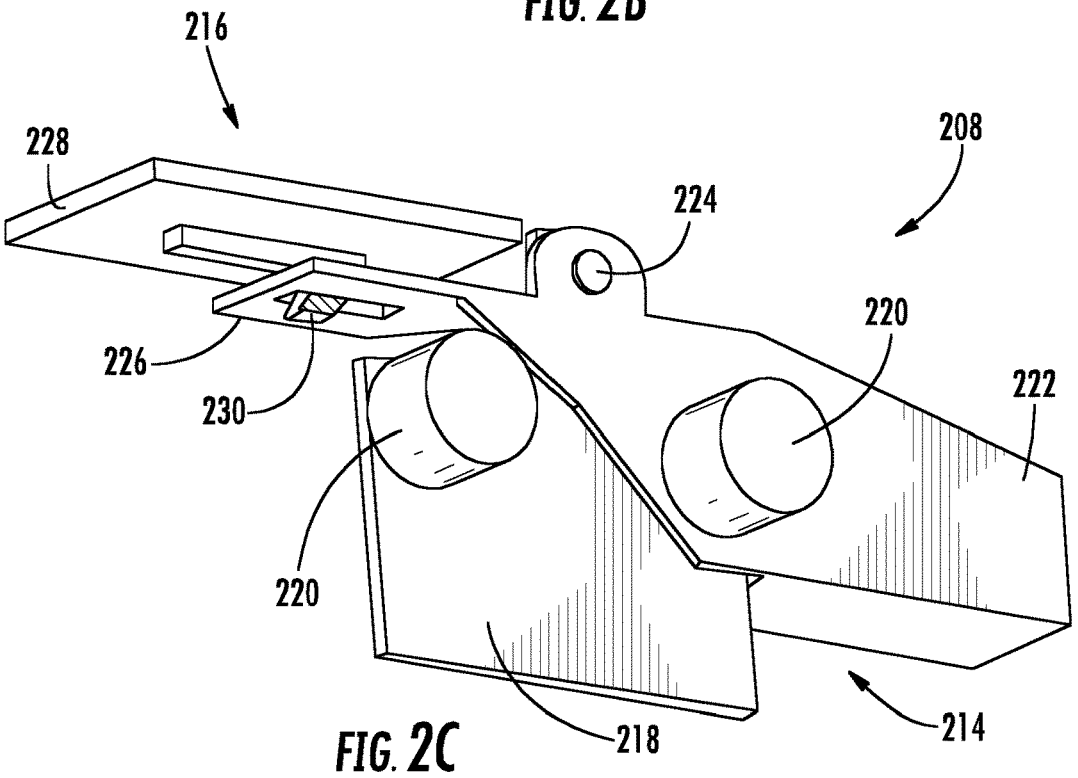
FIG. 2C is an alternative view of the landing door lock of FIG. 2B.

In the embodiment schematically shown in FIG. 2A, the detector 210 is mounted on a top 212 of the elevator car 203. The detector 210 is arranged to detect the operation of the landing door lock 208 to ensure proper engagement of the elements of the landing door lock 208. The detector 210 can be a camera or other visual/optical detector that can detect and measure a feature of the landing door lock 208. In some embodiments, as the elevator car 203 approaches the landing door 225 a, the detector 210 can capture an image of the landing door lock 208 and thus detect the state or operation of the landing door lock 208, as described herein FIGS. 2B-2C illustrate enlarged schematics of the landing door lock 208. The landing door lock 208 includes a first body 214 and a second body 216. The first body 214 and the second body 216 are operable relative to each other to provide secure engagement (when locked) to prevent operation (opening) of the landing doors 225*a*. The first body 214 is fixedly attached to the landing door 225*a* and is thus movable with movement of the landing door 225*a*. The second body 216 is fixedly attached to the landing door frame 206 (e.g., a lintel of the landing door 225*a*) and is fixed in position (e.g., not movable). That is, the first body 214 is a movable portion of the landing door lock 208 and the second body 216 is a fixed portion of the landing door lock 208.

The first body 214 includes various components to enable operation of the landing door lock 208. For example, as shown in FIGS. 2B-2C, the first body 214 includes a first body bracket 218, one or more landing door lock rollers 220, a counterweight 222, a lock pivot 224, and a securing element 226. The first body bracket 218 is fixedly connected to the landing door 225*a* which enables the first body 214 to move with operation of the landing door 225*a*. The counterweight 222 enables a pivoting of the securing element 226 about the lock pivot 224.

The second body 216 includes a second body bracket 228 and a locking element 230. The second body bracket 228 securely and fixedly attaches the second body 216 to the landing door frame 206. The locking element 230 extends from the second body bracket 228. In the embodiment of FIGS. 2B-2C, the locking element 230 is a hook that interacts and releasably engages with the securing element 226 of the first body 214 (e.g., a hole or slot). Those of skill in the art will appreciate that other configurations and/or arrangements of the locking element 230 and the securing element 226 can be employed without departing from the present disclosure.

Figure 3A:
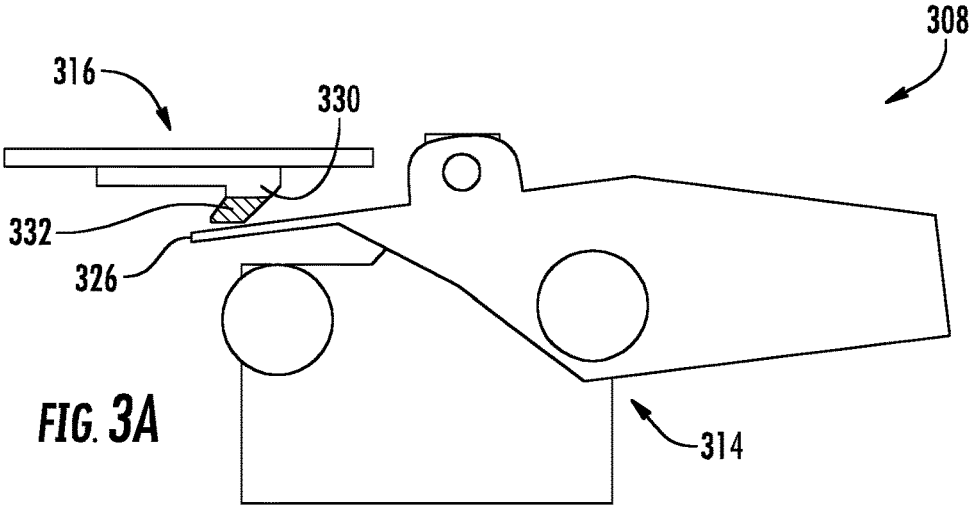
FIG. 3A is a side view illustration of a landing door lock in an open state in accordance with an embodiment of the present disclosure.
Figure 3B:
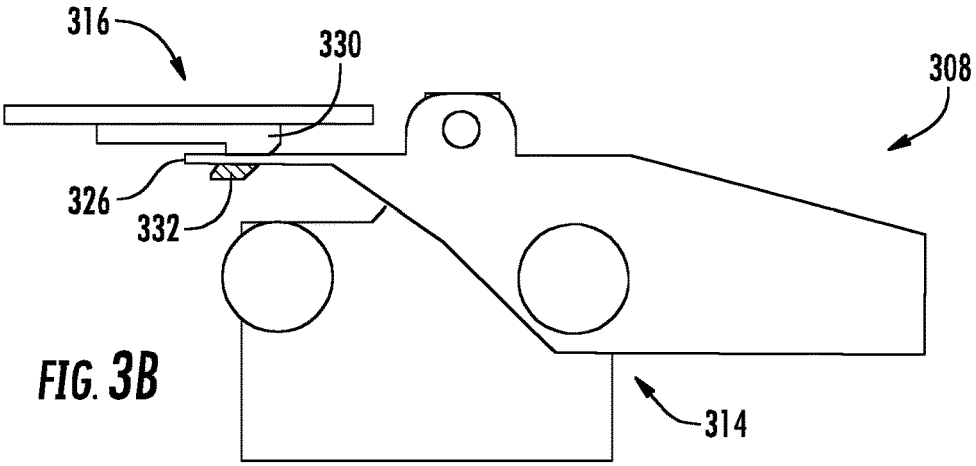
FIG. 3B is a schematic illustration of the landing door lock of FIG. 3A showing the landing door lock in a properly locked state.
Figure 3C:
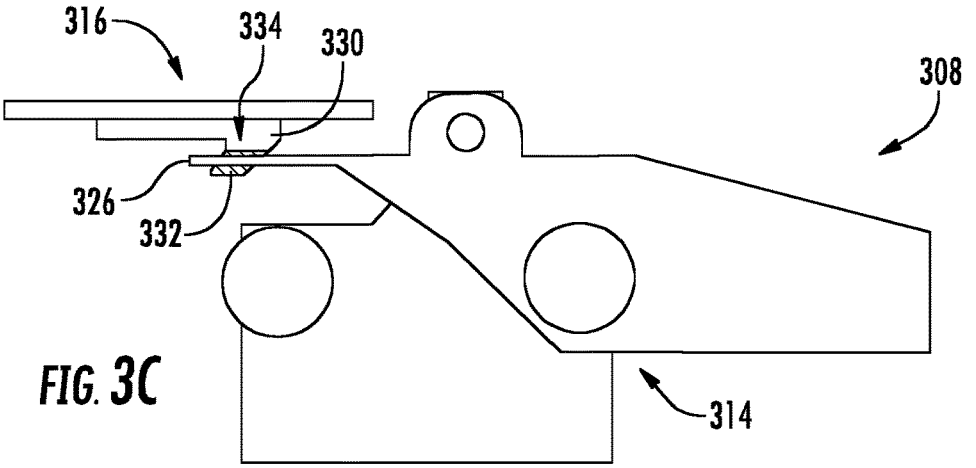
FIG. 3C is a schematic illustration of the landing door lock of FIG. 3A showing the landing door lock in an improperly locked state.

Turning now to FIGS. 3A-3C, illustrations of a landing door lock 308 in various states are schematically shown. FIG. 3A illustrates the landing door lock 308 in an open or unlocked state. FIG. 3B illustrates the landing door lock 308 in a closed or locked state that is properly functioning. FIG. 3C illustrates the landing door lock 308 in a closed or locked state that is malfunctioning. In accordance with some embodiments, FIGS. 3A-3C represent a viewing area of a detector of a landing door lock inspection system (e.g., detector 210 located on top 212 of the elevator car 203 shown in FIG. 2A). The landing door lock 308 of FIGS. 3A-3C is similar to that shown in FIGS. 2B-2C, and thus some features/elements will not be labeled or discussed again for ease of simplicity and clarity.

As shown in FIG. 3A, the landing door lock 208 is in an open or unlocked state that enables a landing door to open. Such state can exist when an elevator car is located at the respective landing door and the elevator car doors and landing doors are to be opened to allow passengers to enter or exit the elevator car. The landing door lock 208 has a first body 314 and a second body 316 similar to that shown and described with respect to FIGS. 2B-2C. The first body 314 includes a securing element 326 that can releasably engage with a locking element 330 that is part of the second body 316. As shown, the locking element 330 includes an indicator element 332 that is selected to be detectable by a detector (e.g., by a camera or other optical/visual device). In the present embodiment, the indicator element 332 is a painted or colored surface on at least a portion of the locking element 330 that interacts with the securing element 326. As described below, the indicator element 332 is selected and arranged to be at least partially obscured or otherwise affected by the interaction and/or presence of the securing element 326 relative to the indicator element 332 and/or the locking element 330.

As noted, FIG. 3B illustrates the landing door lock 308 in a locked state that is in proper operation and FIG. 3C illustrates the landing door lock 308 in a locked state that is improper. The functionality and/or compliance with a desired or required state of operation can be determined by monitoring and/or detecting the indicator element 332 when the landing door lock 308 is in the locked stated. As shown in FIG. 3B, the securing element 326 covers a portion of the indicator element 332 such that when viewed by the detector (e.g., detector 210 shown in FIG. 2A) the indicator element 332 is visible on only one side (e.g., above or below in FIGS. 3A-3C) the obstructing portion of the securing element 326.

In contrast, as shown in FIG. 3C, portions of the indicator element 332 are visible on both sides (e.g., above and below) the obstructing portion of the securing element 326. That is, as shown in FIG. 3C, a portion of the indicator element 332 is visible in a detection region 334 (e.g., a portion of the indicator element 332 is visible above the securing element 326). When a portion of the indicator element 332 is detected within the detection region 334, a controller or other electronic device that is connected to the detector can generate a notification or other message to indicate that the landing door lock 308 is not in proper compliance with preset conditions or requirements.

Figure 4A:
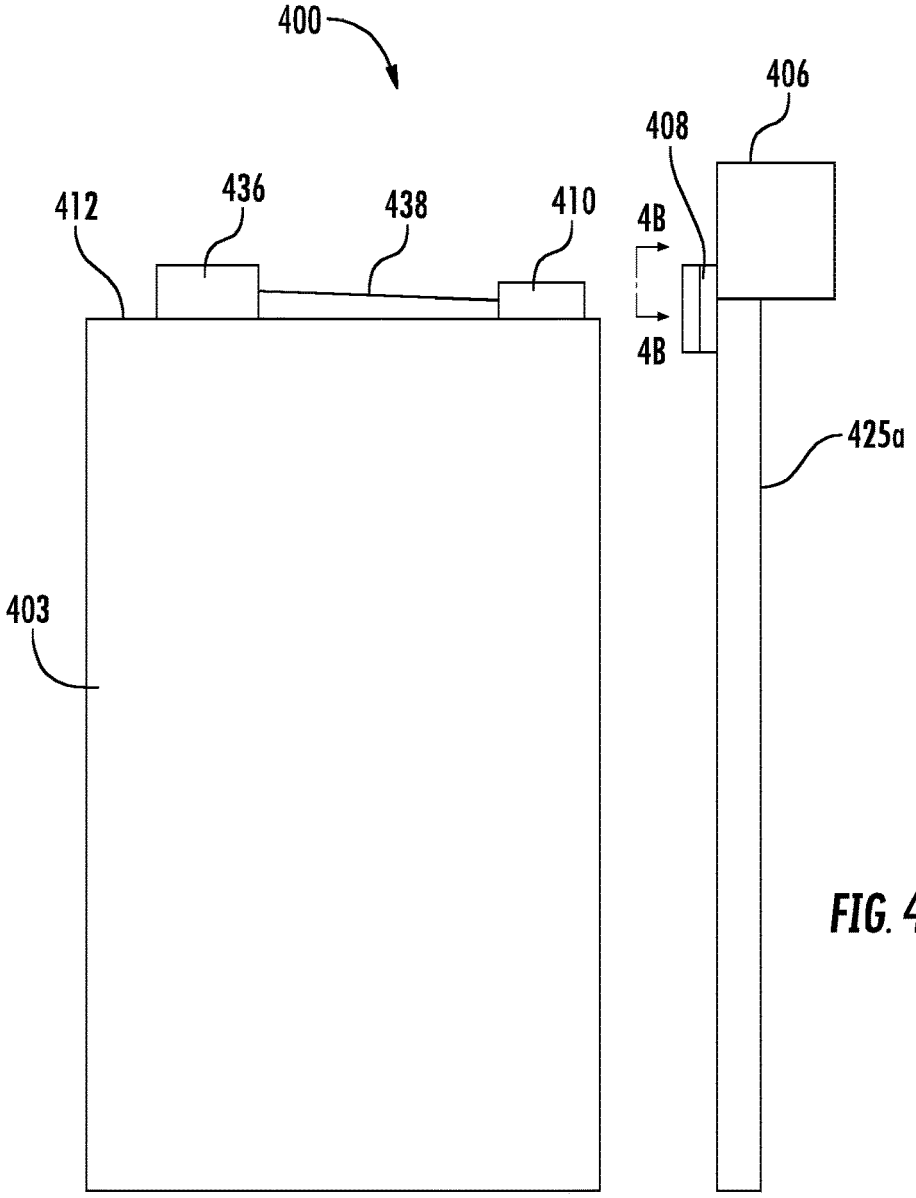
FIG. 4A is a schematic illustration of a landing door lock inspection system in accordance with an embodiment of the present disclosure.
Figure 4B:
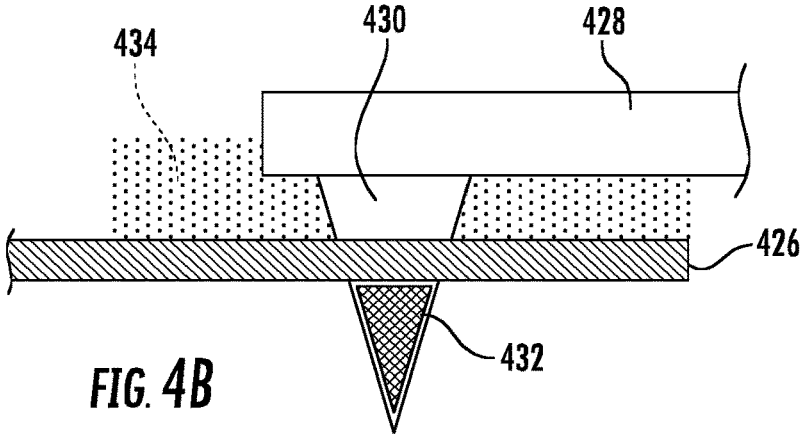
FIG. 4B is a schematic illustration of the landing door lock inspection system as viewed along the line 4B-4B.

Turning now to FIGS. 4A-4B, schematic illustrations of a landing door lock inspection system 400 in accordance with an embodiment of the present disclosure is shown. FIG. 4A is schematic side view of an elevator car 403 with a portion of the landing door lock inspection system 400 installed on a top 412 of the elevator car 403, including a detector 410. FIG. 4B is a schematic illustration as viewed along the line 4B-4B shown in FIG. 4A illustrating a field of view from the detector 410. The detector 410 is arranged to view a landing door lock 408 that is mounted to a landing door 425*a* and landing door frame 406 at a given landing within an elevator shaft.

The portion of the landing door lock inspection system 400 on the elevator car 403 includes the detector 410, a control unit 436, and a communication connection 438 enabling communication between the detector 410 and the control unit 436. The control unit 436 can be a computer or other electronic device that can send commands to and receive data from the detector 410. The communication connection 438 can be a physical line or wire or can be a wireless communication connection, as will be appreciated by those of skill in the art. Further, although shown with the control unit 436 located on the top 412 of the elevator car 403, such arrangement is not to be limiting. For example, in some embodiments, the control unit can be part of an elevator controller or other electronics associated with other parts or components of the elevator system. In some embodiments, the control unit may be located remote from the elevator car. Further, in some embodiments, the control unit may be part of a general purpose computer that is configured to enable maintenance, inspection, and/or monitoring of the elevator system.

The detector 410 is arranged to view the state (e.g., relative position of an indicator element 432) of the landing door lock 408. As shown in FIG. 4B, the detector 410 can view a locking element 430 that is engaged with a securing element 426. As described above, locking element 430 can be part of or mounted to a body bracket 428 of a body of the landing door lock 408. In the embodiment of FIG. 4B, the locking element 430 is part of the movable body of the landing door lock 408 (e.g., movable with the landing doors 425*a*) and the securing element 426 is fixedly mounted to a portion of the landing door frame 406.

The detector 410 is positioned and calibrated such that the detector 410 can detect the presence of the indicator element 432 within a detection region 434. As shown, the detection region 434 is defined as a space or zone that is on one side of the securing element 426 can is selected to be able to determine if the locking element 430 does not sufficiently engage within and to the securing element 426. The control unit 436 (or a portion of the detector 410 depending on electronic configuration) will perform image analysis of the detection region 434 to determine if a portion of the indicator element 432 is present. If no portion of the indicator element 432 is detected within the detection region 434, the control unit 436 will determine that the landing door lock 408 is properly functioning and in compliance with present conditions and/or requirements. However, if a portion of the indicator element 432 is detected within the detection region 434, the control unit 436 will determine that the landing door lock 408 is malfunctioning and/or not in compliance with present conditions and/or requirements. In such an instance, the control unit 436 can generate a notification or other message that can be used to indicate that maintenance is required on the particular landing door lock 408.

The indicator element of embodiments of the present disclosure can take various forms. For example, in some embodiments, the indicator element can be a colored paint that has contrast with the color or texture of the locking element. In such embodiments, the detector can be an optical sensor (e.g., a camera) that is arranged to detect, at least, the presence of the colored paint of the indicator element. In other embodiments, the indicator element can be a reflective or refractive surface, texture, or coating that is applied to or part of the locking element and the detector can be appropriately configured. For example, with a reflective surface indicator element, the detector can include a light source that projects light toward the reflective indicator element. The detector further includes, in such arrangements, a sensor that can detect if any light is reflected from the reflective indicator element. In some embodiments, the indicator element can be a textured surface or other surface feature of the locking element that can be detected by the detector. Further still, in some embodiments, the indicator element can be a coating that is applied and detectable by the detector of the landing door lock inspection system. Moreover, in some embodiments, the detector and/or the indicator element can be selected to operate at (and/or react to) a specific wavelength or range of wavelengths. Those of skill in the art will appreciate that various other types of detectors and/or indicator elements can be employed without departing from the scope of the present disclosure.

Further, in some embodiments, the opposite of the above description may be employed. For example, an error can be indicated by the absence of the indicator element. In such embodiments, the detector and system is configured to monitor for a detection of the indicator element, and such detection can be a confirmation of proper operation of the landing door lock.

Figure 5:
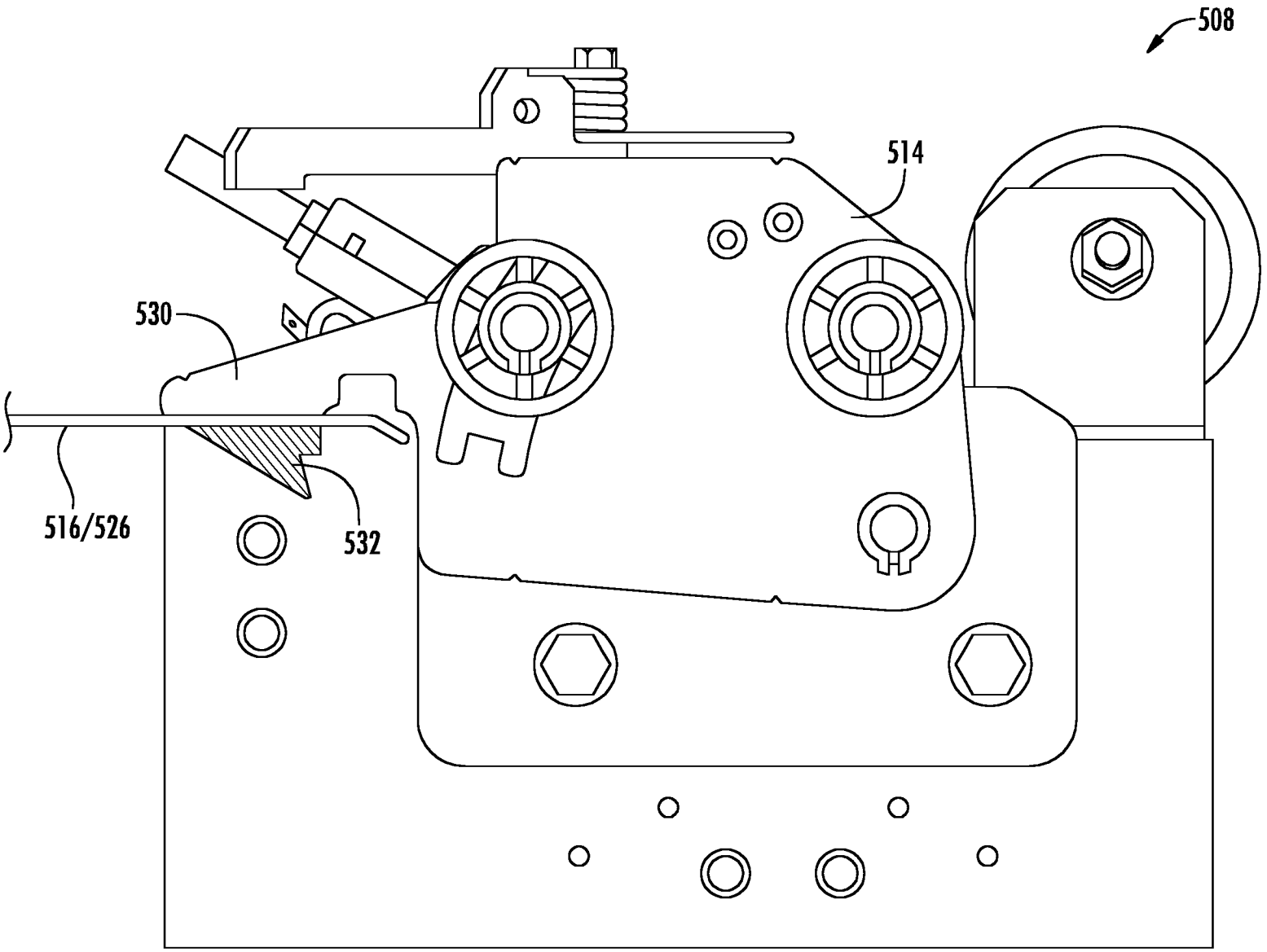
FIG. 5 is a schematic illustration of a landing door lock in accordance with an embodiment of the present disclosure.

Turning now to FIG. 5, a schematic illustration of a landing door lock 508 to be employed with a landing door lock inspection system in accordance with an embodiment of the present disclosure is shown. The landing door lock 508 is similar to the systems and arrangements described above. However, as shown in FIG. 5, the first body 514 includes the locking element 530 and the second body 516 includes the securing element 526. This is in contrast to the arrangement shown and described with respect to FIGS. 3A-3C. The detection of an indicator element 532, however, is the same as that shown and described above, and thus description related thereto will not be repeated.

Figure 6A:
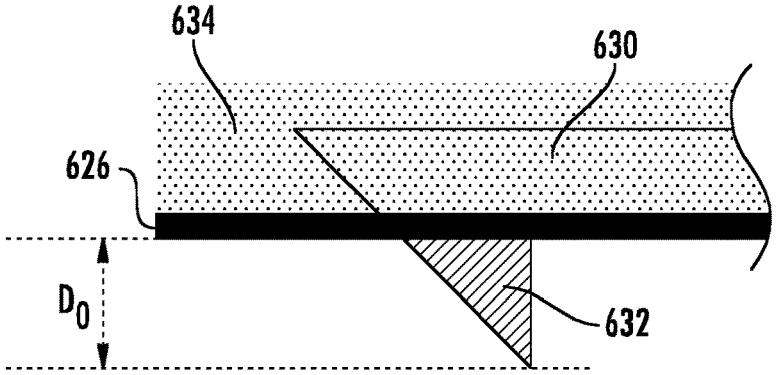
FIG. 6A is a schematic reference illustration showing a locking element engaged with a securing element of a landing door lock in accordance with an embodiment of the present disclosure.
Figure 6B:
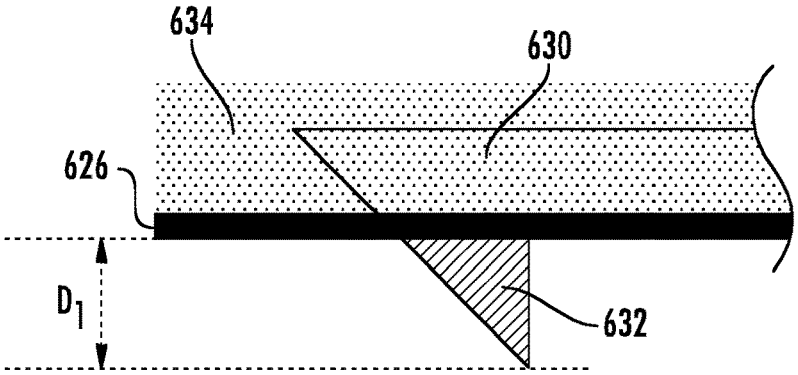
FIG. 6B is a schematic illustration showing a landing door lock in proper operation as viewed by a detector in accordance with an embodiment of the present disclosure.
Figure 6C:
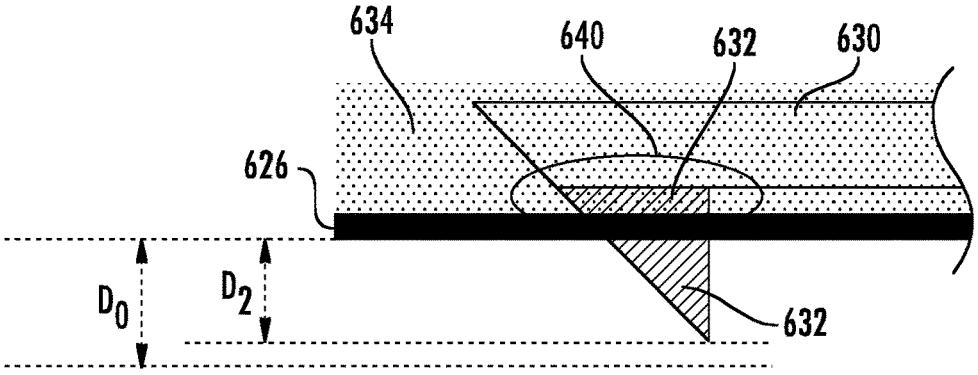
FIG. 6C is a schematic illustration showing a landing door lock that is not properly operating as viewed by a detector in accordance with an embodiment of the present disclosure.

Turning now to FIGS. 6A-6C, schematic illustrations showing a locking element 630 in engagement with a securing element 626 are shown. FIG. 6A is a reference illustration, showing the locking element 630 engaged with the securing element 626, the locking element 630 having an indicator element 632 arranged thereon. Also shown in FIG. 6A, a detection region 634 is schematically shown, which is a region that is viewed by a detector as described herein. FIG. 6A illustrates the locking element 630 in an operational, in compliance state. The operational, in compliance state is defined by a predetermined condition, such as a specific amount or length of the locking element extending through the securing element 626. For example, as schematically shown in FIG. 6A, a minimum distance $D_m$ can be preset, predefined, and/or required based on various considerations. The minimum distance $D_m$ represents a distance of extension of the locking element 630 through the securing element 626. The distance can be selected to ensure that improper unlatching of the locking element is avoided and/or such that proper force is applied between the elements of the landing door lock to ensure the landings doors are securely closed and locked. In one non-limiting example, the minimum distance is 7 mm.

To allow for inspection and monitoring of the state of the locking element 630 (and the landing door lock), the locking element 630 has an indicator element 632 that is applied to or part of the locking element 630 that engages with and/or extends through the securing element 626. The indicator element 632 is arranged such that when the locking element 630 is properly engaged with the securing element 626 (and the minimum distance $D_0$ is satisfied) no amount or portion of the indicator element 632 is detectable within the detection region 634, such as shown in FIG. 6B. As shown in FIG. 6B, the locking element 630 extends a first distance $D_1$ beyond the securing element 626 and no portion of the indicator element 632 is detectable within the detection region 634. The first distance $D_1$ is greater than or equal to the minimum distance $D_0$.

However, as shown in FIG. 6C, the locking element 630 extends a second distance $D_2$. The locking element 630 does not extend through the securing element 626 as far as shown in FIG. 6B, resulting in the lesser second distance $D_2$. The second distance $D_2$ is less than minimum distance $D_0$ and, as shown, a portion 640 of the indicator element 632 is visible within the detection region 634. Detection of the portion 640 of the indicator element 632 within the detection region 634 indicates that the operation of the locking element 630 is not proper and thus a maintenance action may be required to be taken. As such, when a detector and/or control unit detects the portion 640 of the indicator element 632 within the detection region 634, a notification or message can be generated to have maintenance be performed on the specific landing door lock.

In some embodiments, the indicator element 632 is arranged such that when the locking element 630 is properly engaged with the securing element 626 (and the minimum distance $D_0$ is satisfied) at least a portion of the indicator element 632 is detectable within the detection region 634 (e.g., a confirmation region). In such embodiments, when the indicator element 632 is detected a confirmation signal regarding operation can be generated. However, if no portion of the indicator element 632 is detected, then an error signal can be generated.

Figure 7:
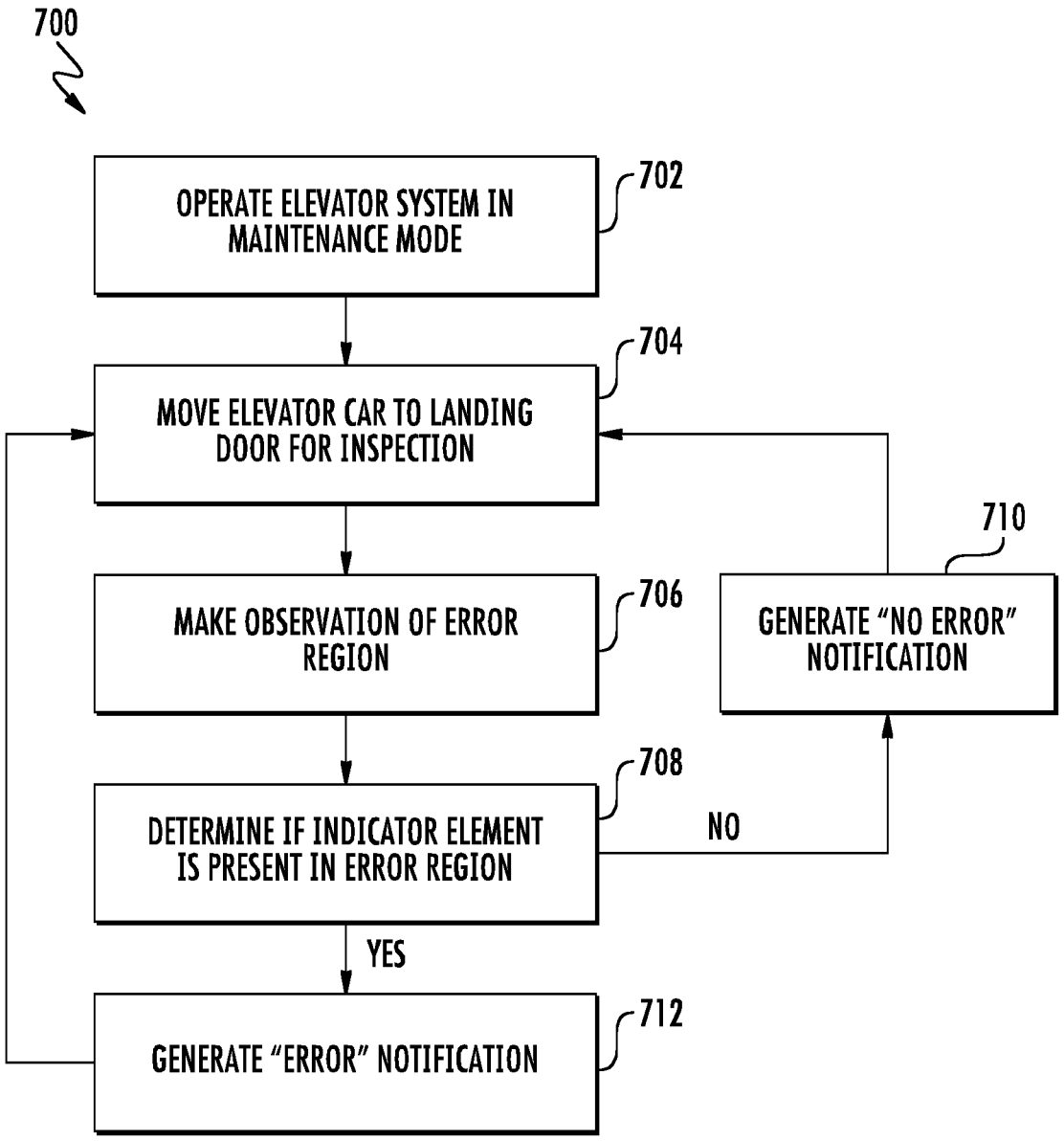
FIG. 7 is a flow process for performing landing door lock inspections in accordance with an embodiment of the present disclosure.

Turning now to FIG. 7, a flow process 700 for performing an automated landing door lock check is shown. The landing door lock check can be performed using an elevator system as shown and described above, having a control unit, detector, one or more landing door lock(s), and an elevator car moveable between landings within an elevator shaft. The landing door lock check can be initiated by a mechanic or other person when it is desirable to the status of one or more landing door locks of an elevator system. Such testing can be performed when an elevator system is first installed within a building and/or may be performed at various times after installation, such as to monitor the landing door locks on a regular maintenance schedule.

For example, the inspection could be automatically performed in an inspection run of the elevator through the elevator shaft on an hourly basis, daily basis, weekly basis, monthly basis, or at any other predetermined interval. In some embodiments, the inspection may be automatically performed every time the elevator stops at a landing. In some embodiments, the inspection may be automatically triggered by a customer complaint. In some embodiments, the inspection may be triggered remotely (e.g., by a remote computer system) or onsite by a mechanic. In one embodiment, the inspection may be triggered automatically in advance of a scheduled maintenance visit by a mechanic to the elevator installation and the results may be sent automatically to the mechanic in advance or saved in the elevator controller for the mechanic to download.

At block 702, the elevator system can be operated in a maintenance mode of operation. The operation within maintenance mode can be optional and in some embodiments, the flow process 700 (omitting block 702) can be performed during normal operation of the elevator system. In embodiments wherein the maintenance mode is activated, such activation can be manual or automatic. For example, in an example of manual operation, a mechanic or technician can use a control element to run the elevator system in maintenance mode to perform inspection or other maintenance operations while the mechanic or technician is present. In other embodiments, the maintenance mode of operation can be automatically activated, such as through an elevator controller or control unit that is programmed to perform automatic inspection and monitoring of various components of the elevator system.

At block 704, the elevator car is moved a landing door for inspection. The landing door can be of any landing within an elevator shaft, but may be preselected based on a maintenance routine (e.g., automated and/or programmed) or based on a selection or instruction from a mechanic or technician (e.g., manual). The movement of the elevator car can be controlled by a control unit to move within the elevator shaft at a maintenance speed of operation that may be slower than a normal operation speed. Such reduced speed can be beneficial for performing landing door lock inspections in accordance with the present disclosure, although such reduced speeds are not required in all embodiments.

At block 706, a detector is used to observe a detection region, such as shown and described above. The detector can be an optical detector or other sensor or device that can detect an indicator element of a landing door lock, as shown and described above. The observation can be a picture or snapshot that is taken at a predetermined position to enable proper detection of the indicator element in the detection region (if present). In some embodiments, the observation can be a video, continuous image capture/detection, and/or a series of image captures or detections. In some embodiments, in addition to a pass/fail determination, an image of the landing door lock may be saved and sent to a mechanic.

At block 708, the detector and/or a control unit analyze the observation made at block 706 to determine if the indicator element (or a portion thereof) is present in the detection region.

If no indicator element is detected, the flow process 700 can end, can continue to a different landing door (i.e., loop back to block 704), or can proceed to block 710 and generate a notification (e.g., no error notification, confirmation notification, etc.). Such notification can be provided to inform a mechanic or technician that the current landing door lock is in compliance with desired operation and/or can be used for generating an inspection history. Accordingly, if no error is detected, a landing door lock inspection system can be configured to operate in various predetermined ways, without departing from the scope of the present disclosure.

In an alternative configuration (e.g., as described above), if the indicator element is detected, the flow process 700 can end, can continue to a different landing door (i.e., loop back to block 704), or can proceed to block 710 and generate a notification or confirmation regarding operation of the landing door lock. Such notification can be provided to inform a mechanic or technician that the current landing door lock is in compliance with desired operation and/or can be used for generating an inspection history. Accordingly, if no error is detected, a landing door lock inspection system can be configured to operate in various predetermined ways, without departing from the scope of the present disclosure.

If, at block 708, it is determined that the indicator element is present in the detection region, the flow process 700 continues to block 712. At block 712, the control unit (or other component) generates an indicator to indicate that there is an error with the specific landing door lock. In some embodiments, if an error message or error notification is generated, the control unit can limit the operation of the elevator system such that a specific elevator speed of travel cannot be exceeded until a "no error" is achieved. Further, upon receiving an error notification or indication, a mechanic can perform a maintenance operation to fix and/or replace the specific landing door lock. After completing the maintenance operation, the system can run the flow process 700 again to determine if the maintenance operation corrected the error with the specific landing door lock.

In some embodiments, if at block 708, it is determined that the indicator element is not present in the detection region, the flow process 700 continues to block 712. At block 712, the control unit (or other component) generates an indicator to indicate that there is an error with the specific landing door lock. In some embodiments, if an error message or error notification is generated, the control unit can limit the operation of the elevator system such that a specific elevator speed of travel cannot be exceeded until a "no error" is achieved. Further, upon receiving an error notification or indication, a mechanic can perform a maintenance operation to fix and/or replace the specific landing door lock. After completing the maintenance operation, the system can run the flow process 700 again to determine if the maintenance operation corrected the error with the specific landing door lock.

In some embodiments, as schematically shown, the flow process 700 can perform a loop with inspection performed at multiple landings in a single instance. For example, if a weekly maintenance inspection operation is performed, the elevator system can perform flow process 700 to inspect every landing door lock within an elevator shaft. When the system detects an error, such error can be noted (e.g., notification at block 712), and the flow process 700 continues until all landing door locks are inspected. At the end of all landing door locks being inspected, a single report can be generated that aggregates the error notifications and no error notifications of the repeated flow process 700. The transmission of the notification can be made using an internet gateway or other similar communication connection and a request for maintenance can be made.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

Advantageously, embodiments described herein provide automated inspection of elevator landing door locks. The automation can be manually implemented and yet not require a technician to enter an elevator shaft, or can be fully automated as described herein.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car within an elevator shaft;

a landing within the elevator shaft, the landing having a landing door;

a landing door lock subject to inspection, the landing door lock having an indicator element thereon, the landing door lock including a first body and a second body arranged to lock the landing door, at least one of the first body and the second body including the indicator element, wherein one of the first body and the second body comprises a securing element and the other of the first body and the second body comprises a locking element, the locking element configured to releasably engage with the securing element to lock the landing door; and an inspection system configured to inspect and monitor the landing door lock, the inspection system comprising a detector located on the elevator car and arranged to detect the presence of the indicator element in a detection region such that, when the indicator element is detected within the detection region, a notification regarding a state of operation of the landing door lock is generated.

2. The elevator system of claim 1, further comprising a control unit, the control unit configured to generate a notification when the indicator element is detected within the detection region.

3. The elevator system of claim 2, wherein the control unit is configured to perform monitoring of the elevator system based on a predefined schedule.

4. The elevator system of claim 2, wherein the control unit is configured to generate a notification or message to indicate that maintenance is required on a particular landing door lock of the elevator system.

5. The elevator system of claim 1, wherein the first body is fixedly attached to the landing door and is movable with movement of the landing door and the second body is fixedly attached to a landing door frame.

6. The elevator system of claim 1, wherein the indicator element is at least one of a colored paint, a textured surface, or a reflective surface on at least a portion of the locking element that interacts with the securing element.

7. The elevator system of claim 1, wherein the indicator element is present on a portion of the respective first body or second body such that when the indicator element is detected within the detection region an error of the landing door lock exists.

8. The elevator system of claim 1, wherein detection of the indicator element within the detection region indicates proper operation of the landing door lock.

9. The elevator system of claim 1, wherein detection of the indicator element within the detection region indicates a malfunction with operation of the landing door lock.

10. A method for inspecting a landing door lock of an elevator system comprising:

moving an elevator car to a landing within an elevator shaft;

observing a detection region using a detector located on the elevator car, the detection region being a region of the landing door lock, the landing door lock comprising a first body and a second body with the first body and second body arranged to lock the landing door, wherein at least one of the first body or the second body includes an indicator element, and wherein one of the first body and the second body comprises a securing element and the other of the first body and the second body comprises a locking element, the locking element configured to releasably engage with the securing element to lock the landing door;

determining if the indicator element is present within the detection region; and generating a notification when the indicator element is present within the detection region.

11. The method of claim 10, further comprising:

moving the elevator car to a second landing within the elevator shaft;

observing a detection region of the second landing using the detector, the detection region being a region of a component to be inspected at the second landing;

determining if an indicator element at the second landing is present within the detection region; and generating an error notification when the indicator element is present within the detection region.

12. The method of claim 10, wherein the method is performed automatically based on at least one of (i) a maintenance schedule, (ii) a predetermined interval, (iii) every time the elevator stops at a landing, (iv) a customer complaint, (v) a request made at an onsite location, (vi) a request made at an offsite location, or (vii) a scheduled maintenance visit.

13. The method of claim 10, further comprising generating, with a control unit, a notification when the indicator element is detected within the detection region.

14. The method of claim 10, further comprising monitoring, with a control unit, the elevator system based on a predefined schedule.

15. The method of claim 10, further comprising generating a notification or message to indicate that maintenance is required at a particular landing door lock of the elevator system.

16. The method of claim 10, wherein the first body is fixedly attached to the landing door and is movable with movement of the landing door and the second body is fixedly attached to a landing door frame.

17. The method of claim 10, wherein the indicator element is present on a portion of the respective first body or second body such that when the indicator element is detected within the detection region an error of the landing door lock exists.

18. The method of claim 10, wherein detection of the indicator element within the detection region indicates proper operation of the landing door lock.

19. The method of claim 10, wherein detection of the indicator element within the detection region indicates a malfunction with operation of the landing door lock.

20. The method of claim 10, wherein the indicator element is at least one of a colored paint, a textured surface, or a reflective surface on at least a portion of the locking element that interacts with the securing element.

* * * * *